US010928080B2

(12) United States Patent
Shoemaker et al.

(10) Patent No.: US 10,928,080 B2
(45) Date of Patent: Feb. 23, 2021

(54) CLIMATE CONTROL OUTDOOR UNIT WITH INVERTER COOLING

(71) Applicant: Carrier Corporation, Jupiter, FL (US)

(72) Inventors: Mark W. Shoemaker, Brownsburg, IN (US); Derek A. Leman, Brownsburg, IN (US)

(73) Assignee: Carrier Corporation, Palm Beach Gardens, FL (US)

( * ) Notice: Subject to any disclaimer, the term of this patent is extended or adjusted under 35 U.S.C. 154(b) by 888 days.

(21) Appl. No.: 15/347,007

(22) Filed: Nov. 9, 2016

(65) Prior Publication Data

US 2017/0130975 A1 May 11, 2017

Related U.S. Application Data

(60) Provisional application No. 62/253,001, filed on Nov. 9, 2015.

(51) Int. Cl.

| | |
|---|---|
| ***F24F 1/24*** | (2011.01) |
| ***F24F 1/56*** | (2011.01) |
| ***F24F 1/50*** | (2011.01) |

(52) U.S. Cl.

CPC ..... *F24F 1/24* (2013.01); *F24F 1/50* (2013.01); *F24F 1/56* (2013.01)

(58) Field of Classification Search

CPC ..... F24F 1/24; F24F 1/50; F24F 1/56; F24F 1/20; F24F 1/22; F24F 11/88; F24F 11/89

See application file for complete search history.

(56) References Cited

U.S. PATENT DOCUMENTS

| | | | | |
|---|---|---|---|---|
| 6,094,928 | A * | 8/2000 | Oyabu | F24F 1/46 62/259.1 |
| 6,320,776 | B1 * | 11/2001 | Kajiura | H02M 7/003 361/709 |
| 7,363,768 | B2 | 4/2008 | Fuchikami et al. | |
| 7,377,237 | B2 | 5/2008 | Carney et al. | |
| 7,609,024 | B2 | 10/2009 | Ahmad et al. | |
| 8,289,709 | B2 | 10/2012 | Feltner et al. | |
| 8,482,163 | B2 | 7/2013 | Belikoff et al. | |

(Continued)

FOREIGN PATENT DOCUMENTS

| | | |
|---|---|---|
| CN | 202425279 U | 9/2012 |
| CN | 204090350 U | 1/2015 |

(Continued)

OTHER PUBLICATIONS

25VNA Infinity Variable Speed Heat Pump with Greenspeed Intelligence 2 to 5 Nominal Tons (Service Manual), Jan. 2012, Carrier Corporation, Indianapolis, Indiana.

(Continued)

*Primary Examiner* — Nelson J Nieves
*Assistant Examiner* — Miguel A Diaz
(74) *Attorney, Agent, or Firm* — Bachman & LaPointe, P.C.

(57) ABSTRACT

A climate control outdoor unit has: a housing; a compressor having an electric motor; a refrigerant-air heat exchanger; an electric fan positioned to drive an air flow along an air flowpath across the refrigerant-air heat exchanger; and an inverter unit coupled to the electric motor to drive the electric motor. An additional air flowpath extends along the inverter unit to merge with the air flowpath.

20 Claims, 6 Drawing Sheets

(56) References Cited

U.S. PATENT DOCUMENTS

| | | | | |
|---|---|---|---|---|
| 8,978,393 | B2 | 3/2015 | Hilo et al. | |
| 9,228,771 | B2 * | 1/2016 | Kamitani | F24F 1/22 |
| 9,273,896 | B2 * | 3/2016 | Sao | F24F 1/24 |
| 9,353,968 | B2 * | 5/2016 | Hayakawa | F24H 3/022 |
| 2005/0144975 | A1 * | 7/2005 | Fuchikami | F24F 1/20 62/508 |
| 2008/0092576 | A1 * | 4/2008 | Hoffman | F24F 1/50 62/259.1 |
| 2009/0081940 | A1 * | 3/2009 | Jang | F24F 1/22 454/184 |
| 2009/0137197 | A1 * | 5/2009 | Jang | F24F 1/50 454/184 |
| 2012/0274188 | A1 * | 11/2012 | Shiborino | F24F 1/20 312/100 |
| 2013/0255298 | A1 | 10/2013 | Amano | |
| 2014/0124175 | A1 * | 5/2014 | Sao | F24F 1/38 165/121 |
| 2014/0326437 | A1 * | 11/2014 | Kamitani | F24F 1/22 165/122 |
| 2015/0075203 | A1 * | 3/2015 | Mochizuki | F24F 1/20 62/324.5 |
| 2015/0276263 | A1 * | 10/2015 | Hayakawa | F24H 3/022 392/360 |
| 2015/0276279 | A1 * | 10/2015 | Hayakawa | F24F 1/22 62/324.6 |
| 2016/0123348 | A1 * | 5/2016 | Yi | F04D 29/5806 417/423.8 |
| 2017/0130975 | A1 * | 5/2017 | Shoemaker | F24F 1/50 |
| 2018/0043749 | A1 * | 2/2018 | Lim | B60H 1/00557 |
| 2019/0024911 | A1 * | 1/2019 | Hayakawa | H05K 7/1438 |
| 2019/0041070 | A1 * | 2/2019 | Abe | F25B 31/006 |
| 2019/0226690 | A1 * | 7/2019 | Torii | F24F 1/22 |

FOREIGN PATENT DOCUMENTS

| | | | | | |
|---|---|---|---|---|---|
| CN | 104713204 | A | | 6/2015 | |
| EP | 0933603 | A1 | | 8/1999 | |
| JP | 0526476 | A | | 2/1993 | |
| JP | 2014092306 | A | * | 5/2014 | |
| KR | 101189391 | B1 | | 10/2012 | |
| WO | WO-2005031219 | A1 | * | 4/2005 | F24F 1/50 |
| WO | WO-2009104471 | A1 | * | 8/2009 | F24F 1/20 |
| WO | 2013/054699 | A1 | | 4/2013 | |
| WO | WO-2017022023 | A1 | * | 2/2017 | F24F 1/24 |
| WO | WO-2017029696 | A1 | * | 2/2017 | F24F 1/20 |

OTHER PUBLICATIONS

Service Handbook, Aug. 2009, Mitsubishi Electric, Japan.

* cited by examiner

CLIMATE CONTROL OUTDOOR UNIT WITH INVERTER COOLING

CROSS-REFERENCE TO RELATED APPLICATION

Benefit is claimed of U.S. Patent Application No. 62/253,001, filed Nov. 9, 2015, and entitled "Climate Control Outdoor Unit with Inverter Cooling", the disclosure of which is incorporated by reference herein in its entirety as if set forth at length.

BACKGROUND

The disclosure relates to climate control. More particularly, the disclosure relates to outdoor units.

A typical residential climate control (air conditioning and/or heat pump) system has an outdoor unit including a compressor, a refrigerant-air heat exchanger, and an electric fan for driving an air flow across the heat exchanger.

The outdoor unit will often include an inverter for powering the compressor motor. Cooling of the inverter is an important feature for capacity and longevity. Cooling is particularly relevant in air conditioning (cooling) modes when the outdoor unit is in high ambient temperature conditions. However, properly cooling the inverter faces constraints of packaging and efficiency. In one basic outdoor unit configuration, the outdoor unit has a generally square footprint with the heat exchanger wrapping around four sides and three corners of that footprint between two headers. A service panel of the housing is mounted aligned with the gap and carries the inverter. A heat sink of the inverter faces the gap and is exposed to the air flow in the central cavity of the outdoor unit. The fan is mounted atop the outdoor unit and draws air inward through the heat exchanger to the central cavity and then exhausts it upward.

SUMMARY

One aspect of the disclosure involves a climate control outdoor unit comprising: a housing; a compressor having an electric motor; a refrigerant-air heat exchanger; an electric fan positioned to drive an air flow along an air flowpath across the refrigerant-air heat exchanger; and an inverter unit coupled to the electric motor to drive the electric motor. An additional air flowpath extends along the inverter unit to merge with the air flowpath.

In one or more embodiments of any of the foregoing embodiments, the inverter unit is mounted on a service panel of the housing. The inverter unit has: a heat sink having a heat rejection section along the air flowpath protruding from an interior side of the service panel; and a portion protruding from an exterior side of the first panel and enclosed by a control box of the housing. The control box has a rear panel facing the service panel and locally spaced apart from the service panel by a gap. The additional air flowpath extends: into the control box; upward along the inverter unit portion; rearward from the control box; through the service panel; and merging with the air flowpath.

In one or more embodiments of any of the foregoing embodiments: the additional air flowpath enters the control box through one or more inlets along the control box rear panel; and the additional air flowpath exits the control box through one or more outlets along the control box rear panel.

In one or more embodiments of any of the foregoing embodiments: the one or more inlets comprise a vertically arrayed plurality of louvered inlets; and the one or more outlets comprise a vertically arrayed plurality of louvered outlets.

In one or more embodiments of any of the foregoing embodiments, the additional air flowpath passes through one or more ports in the service panel laterally spaced apart from the one or more outlets.

In one or more embodiments of any of the foregoing embodiments, the one or more ports in the service panel are at least partially vertically below the one or more outlets.

In one or more embodiments of any of the foregoing embodiments, the control box rear panel has lateral portions mounted to the service panel.

In one or more embodiments of any of the foregoing embodiments: the refrigerant-air heat exchanger extends around a vertical axis of the climate control outdoor unit between a first header and a second header; and the service panel is adjacent a gap between the first header and the second header In one or more embodiments of any of the foregoing embodiments, the electric fan is atop the outdoor unit.

In one or more embodiments of any of the foregoing embodiments, the portion protruding from the exterior side of the service panel comprises power electronics of the inverter unit.

In one or more embodiments of any of the foregoing embodiments, the inverter is configured to receive single-phase AC power and output three-phase AC power with variable voltage.

In one or more embodiments of any of the foregoing embodiments, the indoor unit further comprises an expansion device upstream of the refrigerant-air heat exchanger in a heating mode.

Another aspect of the disclosure involves a climate control system including the climate control outdoor unit and further comprising an indoor unit. The indoor unit comprises: a refrigerant-air heat exchanger downstream of the outdoor unit refrigerant-air heat exchanger and upstream of the compressor along a refrigerant flowpath; and an electric fan positioned to drive an air flow along an air flowpath across the indoor unit refrigerant-air heat exchanger.

In one or more embodiments of any of the foregoing embodiments, the indoor unit further comprises an expansion device upstream of the indoor unit refrigerant-air heat exchanger in a cooling mode.

Another aspect of the disclosure involves method for using the system. The method comprises: running the electric motor of the compressor to drive refrigerant through the refrigerant-air heat exchanger; and running the electric fan. The running the electric fan: drives the air flow along the air flowpath across the refrigerant-air heat exchanger; and drives an additional air flow along the additional air flowpath. The air along the additional flowpath is driven: into a control box; upward along the inverter unit; rearward from the control box; through a service panel; and merging with the air flowpath.

In one or more embodiments of any of the foregoing embodiments, heat is absorbed from the air flow by the refrigerant-air heat exchanger.

In one or more embodiments of any of the foregoing embodiments, the additional air flow is drawn upward into the gap and then forwardly into the control box.

Another aspect of the disclosure involves method for operating a climate control outdoor unit. The climate control outdoor unit comprises: a housing; a compressor having an electric motor; a refrigerant-air heat exchanger; an electric fan positioned to drive an air flow along an air flowpath across the refrigerant-air heat exchanger; and an inverter coupled to the electric motor to drive the electric motor and mounted on a service panel of the housing. The inverter has: a heat sink having a heat rejection section along the air flowpath protruding from an interior side of the service panel; and a portion protruding from an exterior side of the first panel and enclosed by a control box of the housing. The method comprises running the electric fan to: draw a first air flow into the outdoor unit and across the refrigerant-air heat exchanger and the heat sink heat rejection section; and draw a second air flow along the portion of the inverter.

In one or more embodiments of any of the foregoing embodiments, the second air flow is drawn sequentially, into the control box, across the portion, out of the control box, and through the service panel.

In one or more embodiments of any of the foregoing embodiments, the second air flow is drawn laterally between the control box and the service panel.

In one or more embodiments of any of the foregoing embodiments, the second air flow is drawn downwardly between the control box and the service panel.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
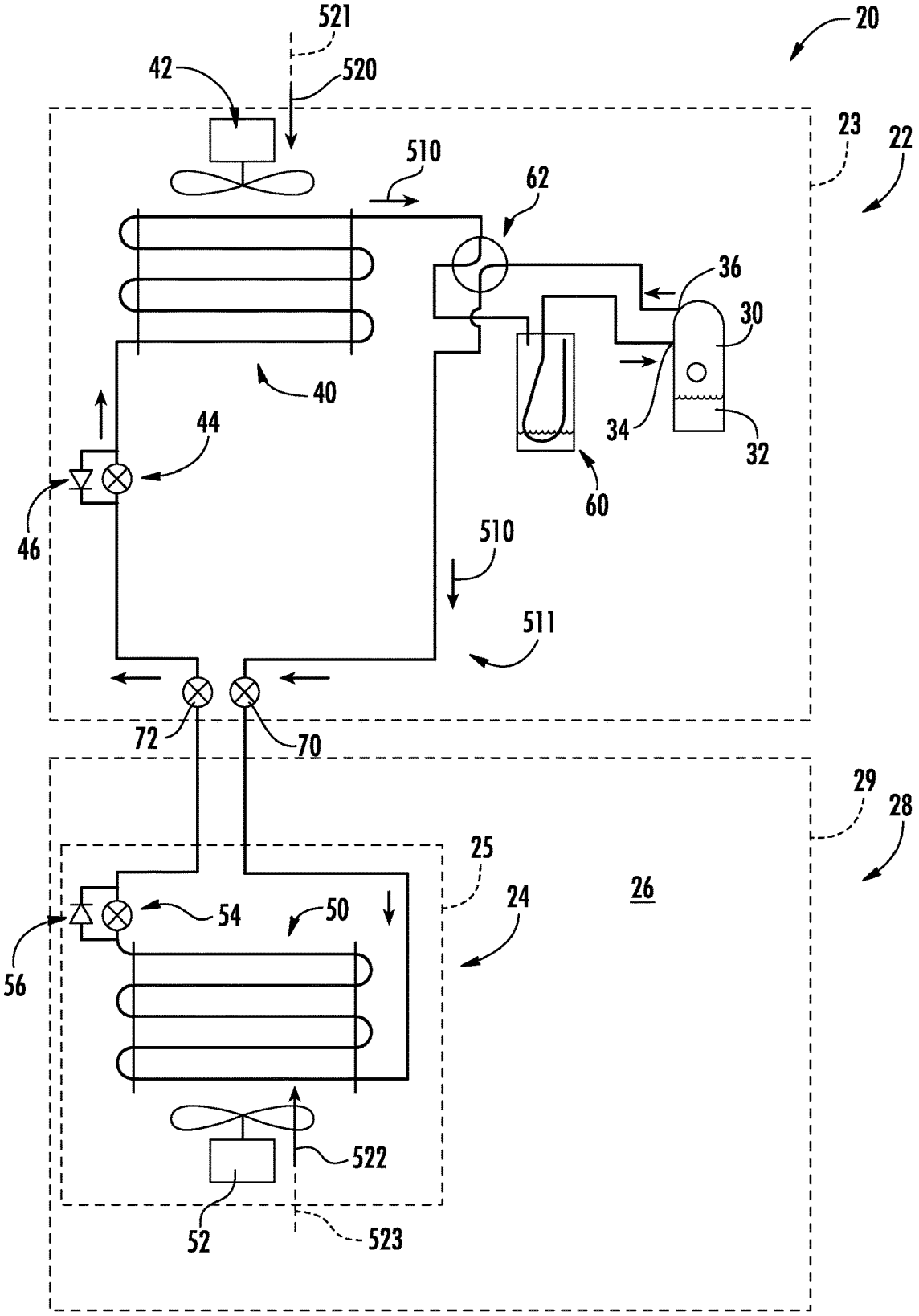
FIG. 1 PRIOR ART
FIG. 1 is a schematic view of a heat pump system in a heating mode.

FIG. 1 shows one example of a heat pump unit 20 having an outdoor unit 22 (having a housing 23) and an indoor unit 24 (having a housing 25). The indoor unit 24 is within the interior 26 of a building 28. As is discussed further below, the exemplary heat pump is a combination heat pump and air conditioner having both heating (FIG. 1) and cooling (FIG. 2) modes. The exemplary heat pump outdoor unit contains an electrically-powered compressor 30 having a motor 32. The compressor drives a refrigerant flow along a refrigerant flowpath entering the compressor at a suction port 34 and exiting the compressor at a discharge port 36. The various illustrated lines may be of conventional refrigerant line/conduit construction.

The outdoor unit has an outdoor heat exchanger 40 (e.g., a refrigerant-air heat exchanger) and an electric fan 42 for driving an air flow 520 along an air flowpath 521 across the outdoor heat exchanger. Similarly, the indoor unit has an indoor heat exchanger 50 (e.g., a refrigerant-air heat exchanger) and an electric fan 52 for driving an air flow 522 along an air flowpath 523 across the indoor heat exchanger. The exemplary flow 520 passes from an inlet of the housing 23 of the outdoor unit to an outlet of the housing. Similarly, the flow 522 may pass from an inlet of the indoor unit to an outlet of the indoor unit to return to the interior 26. Other more complex systems involving air exchange are possible. The exemplary outdoor unit further includes an expansion device 44 for use in the heating mode (e.g., a thermal expansion valve, electronic expansion valve, orifice, or the like). A check valve bypass 46 is provided to bypass the expansion device 44 in the cooling mode. Similarly, the indoor unit includes a heating mode expansion device 54 and a bypassing check valve 56.

The exemplary outdoor unit further comprises an accumulator 60 and one or more switching valves for switching between the heating mode and the cooling mode. The exemplary illustrated switching valve is a four-way valve 62.

In the heating mode, a flow 510 of refrigerant is compressed by the compressor and passes along a refrigerant flowpath 511 from the discharge port through the exemplary switching valve 62 along a line (vapor line) passing out from the outdoor unit and entering the building to ultimately enter the indoor unit to feed the indoor heat exchanger 50. In this mode, the indoor heat exchanger 50 serves as a heat rejection heat exchanger rejecting heat to the air flow 522 (e.g., acting as a condenser or gas cooler). The cooled refrigerant flow then passes through the bypass 56 and back out of the indoor unit and building via a line (liquid line) to re-enter the outdoor unit. FIG. 1 shows an exemplary pair of service valves 70 and 72 in the outdoor unit allowing service thereof. After passing into the outdoor unit, the refrigerant proceeds through the expansion device 44 to the heat exchanger 40 which therefore serves conventionally as a heat absorption heat exchanger or evaporator absorbing heat from the air flow 520. The refrigerant then returns via the valve 62 and exemplary accumulator 60 to the suction port 34.

Figure 2:
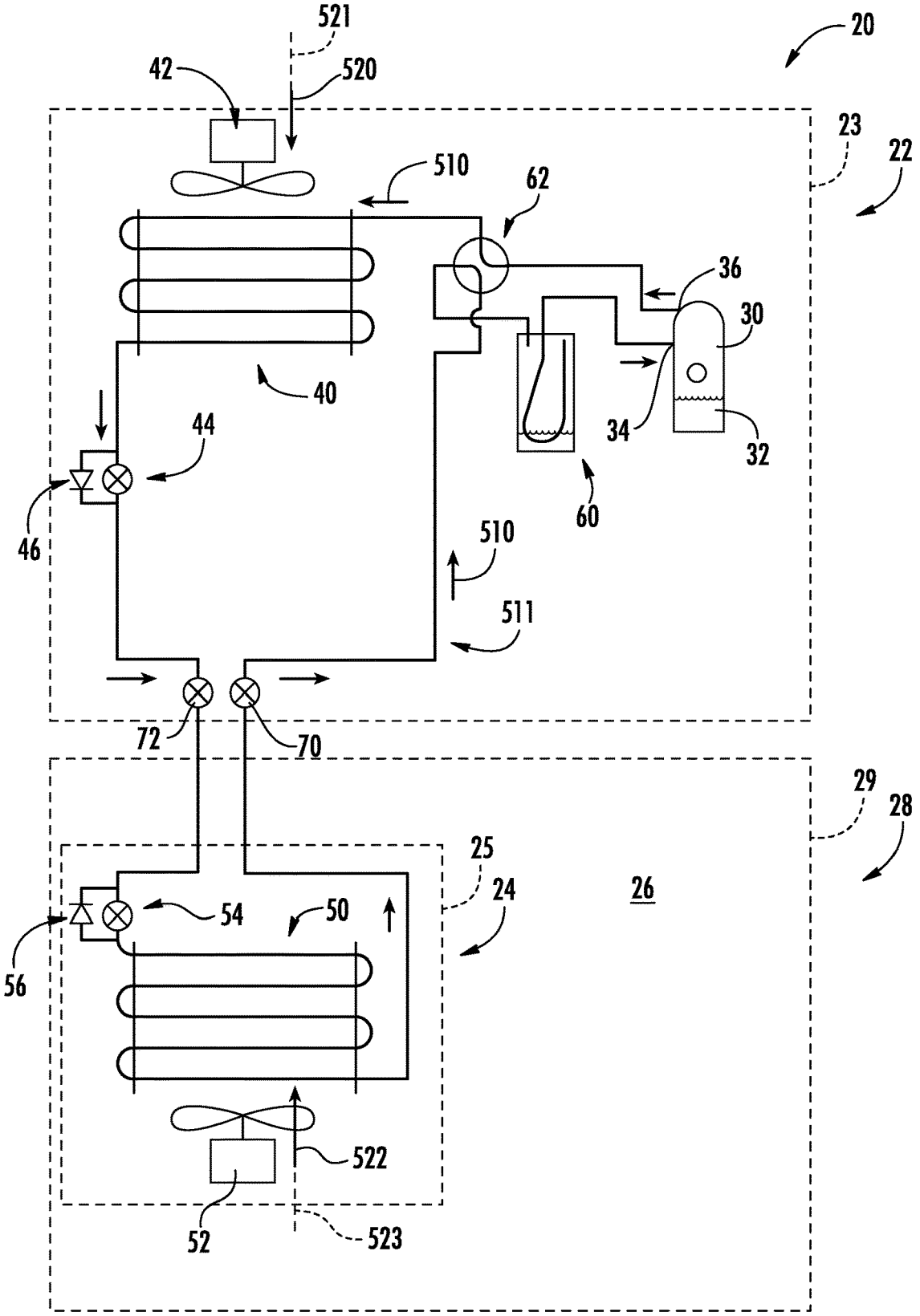
FIG. 2 PRIOR ART
FIG. 2 is a schematic view of the heat pump system in a cooling mode.

The FIG. 2 cooling mode generally reverses direction of flow through the heat exchangers with the compressed refrigerant passing initially to the outdoor heat exchanger, then through the bypass 46 and through the expansion device 54 and indoor heat exchanger 50 to ultimately return. Thus in the cooling mode, the outdoor heat exchanger serves as a heat rejection heat exchanger and the indoor heat exchanger serves as a heat absorption heat exchanger rejecting heat to and absorbing heat from their respective associated air flows.

As discussed further below, the exemplary compressor motor 32 is powered by an inverter. Inverter cooling is a critical factor in system operation.

Figure 3:
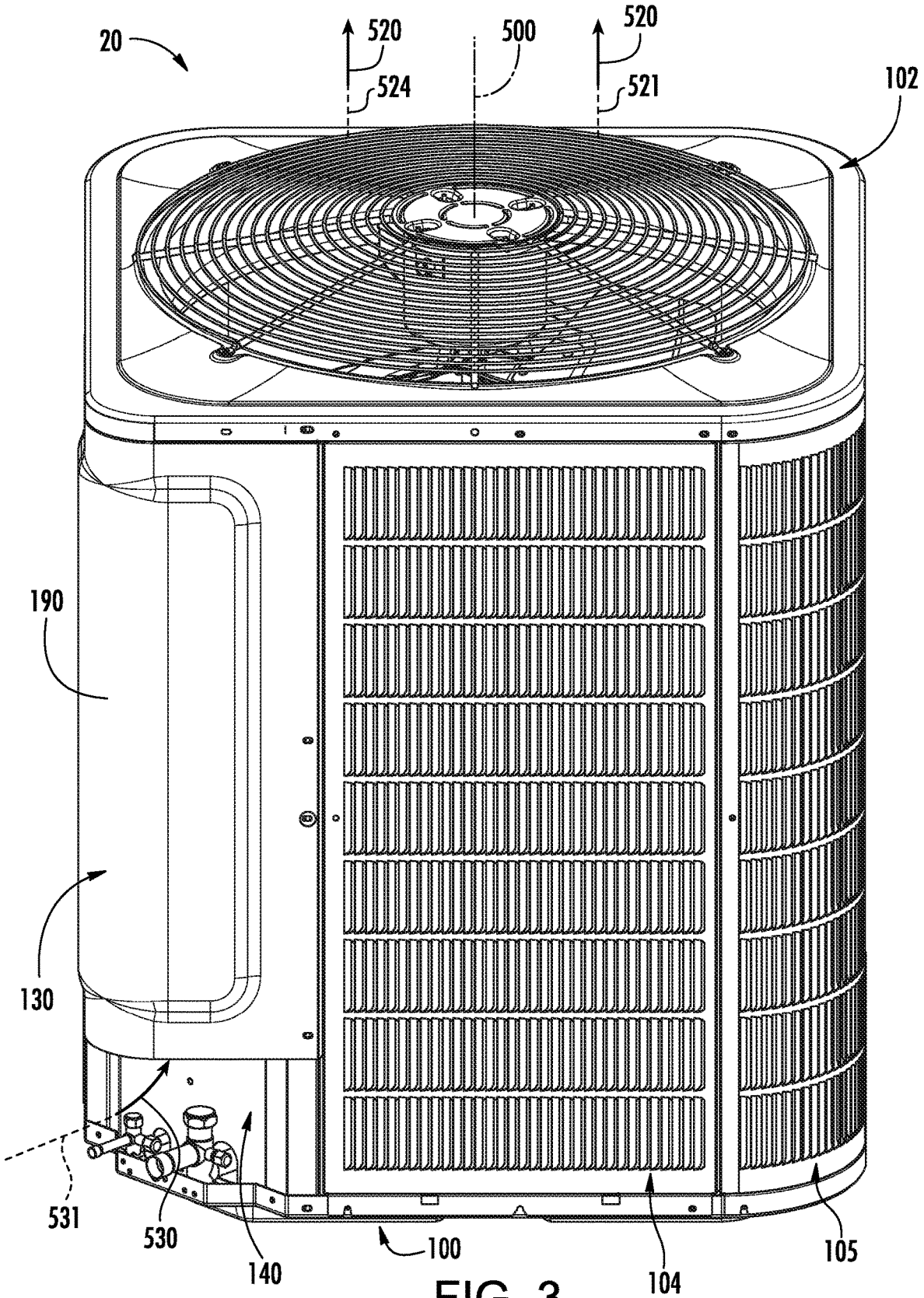
FIG. 3 is a side view of an outdoor unit of the heat pump system.
Figure 4:
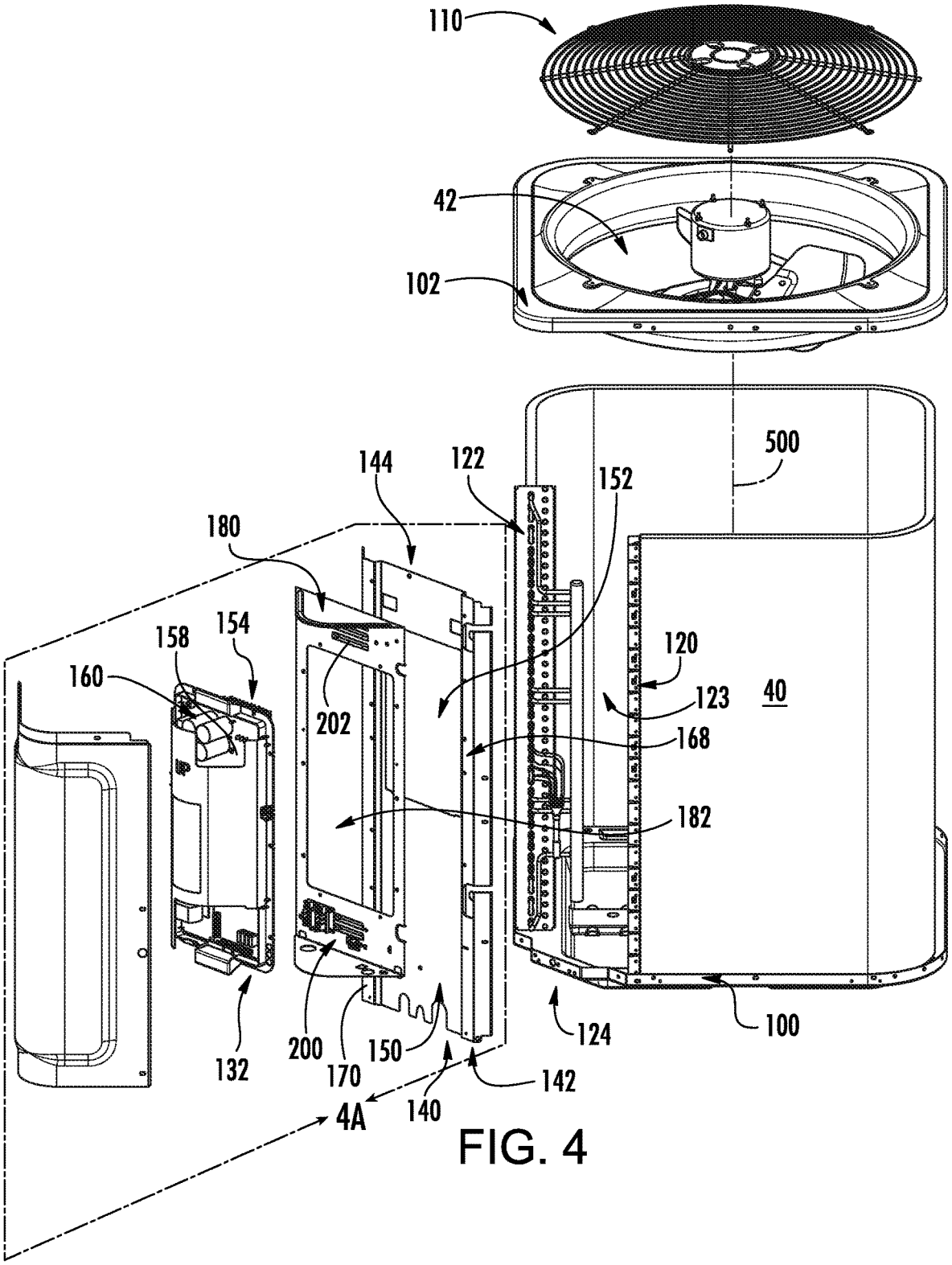
FIG. 4 is an exploded partial view of the outdoor unit.

FIG. 3 shows an exemplary outdoor unit 22. FIG. 4 is an exploded partial view of the outdoor unit. The outdoor unit has a base (base pan) 100 of generally square (e.g., with rounded or faceted corners) planform. The base (base pan) supports the remainder of the outdoor unit components.

The base pan forms a portion of the housing 23. The housing extends upward to include a top cover 102. Along the lateral perimeter, one or more louver panels 104 and/or corner posts 105 (also shown louvered in the illustrated embodiment) or other structural members may connect the base pan to the top cover. The louver openings form an air inlet along the outdoor unit air flowpath and the top cover forms an air outlet. The top cover may be an assembly carrying the fan 42 and optionally integrated with a housing/shroud of said fan. The exemplary fan and its motor define a central vertical axis 500 shared with the remainder of the outdoor unit. At a top of the top cover, the top cover assembly may include a screen or fan guard 110.

Figure 4A:
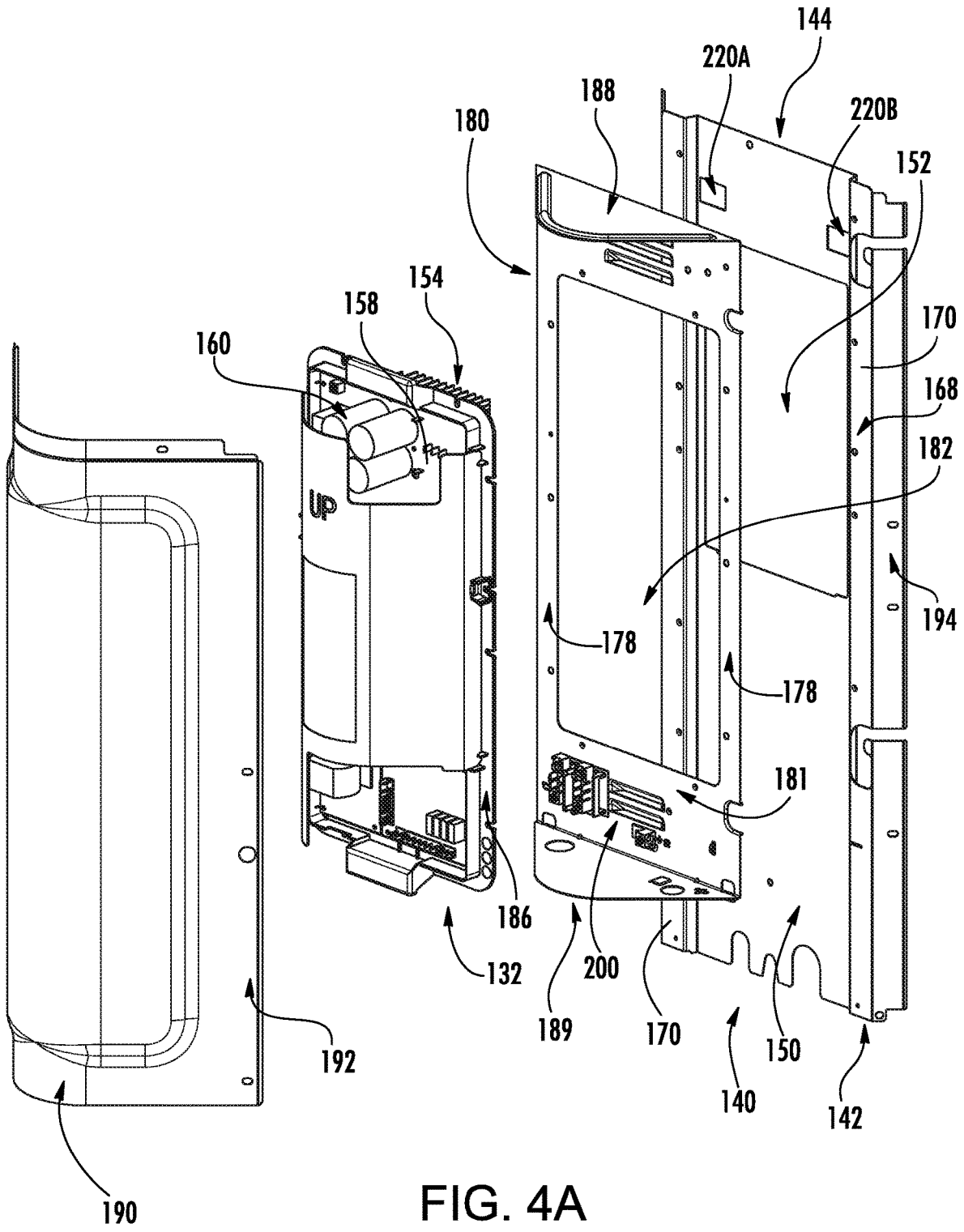
FIG. 4A is an enlarged view of a service panel and control box of the outdoor unit.

The exemplary outdoor heat exchanger 40 comprises a tube array wrapping generally around four sides and three corners of the footprint of the outdoor unit between a first header 120 and a second header 122. A gap 123 between the two headers is aligned generally with one corner 124 of the footprint of the outdoor unit. A control box 130 (FIG. 3) is vertically mounted along this corner and contains the compressor motor control/inverter unit 132 (FIG. 4A) and other associated components. The compressor (not shown) may be located centrally within the outdoor heat exchanger supported atop the base pan. Exemplary input power is single phase AC (e.g., nominal 220V, 60 Hz). Exemplary output of the inverter unit is three-phase AC (e.g., varying in voltage, current, and frequency). Inverter power is typically limited by current and inverter temperature.

A service panel 140 (e.g., stamped sheet metal) serves to ultimately mount the inverter unit 132. The exemplary service panel extends from a lower end 142 mounted to the base pan (e.g., secured via screws or other fasteners) to an upper end 144 mounted to the top cover. This is in similar fashion to the attachments of corner posts or other structural supports (not shown).

The exemplary service panel has a central portion 150 (FIG. 4A) which is generally flat and has a large aperture 152 for passing a heat sink 154 of the inverter unit 132. A heat rejection section 155 of the heat sink (FIG. 5) may be formed as a laterally arrayed group of vertical fins and protrudes from an inboard or interior side (face) of the service panel in toward the interior of the outdoor unit to be exposed to the air flow 520. The inverter unit further includes a main circuit board (printed circuit board (PCB)) 158. The exemplary heat sink is mounted to an inboard side of the circuit board and various inverter unit components 160 are mounted on an outboard side of the circuit board. The components may include the inverter power electronics and other power and/or control components. Depending upon the configuration of inverter, different components are most critical for cooling. Typically, these will include one or more of the inverter microcontroller of other processor or integrated circuit(s), inductors, and capacitors.

Figure 5:
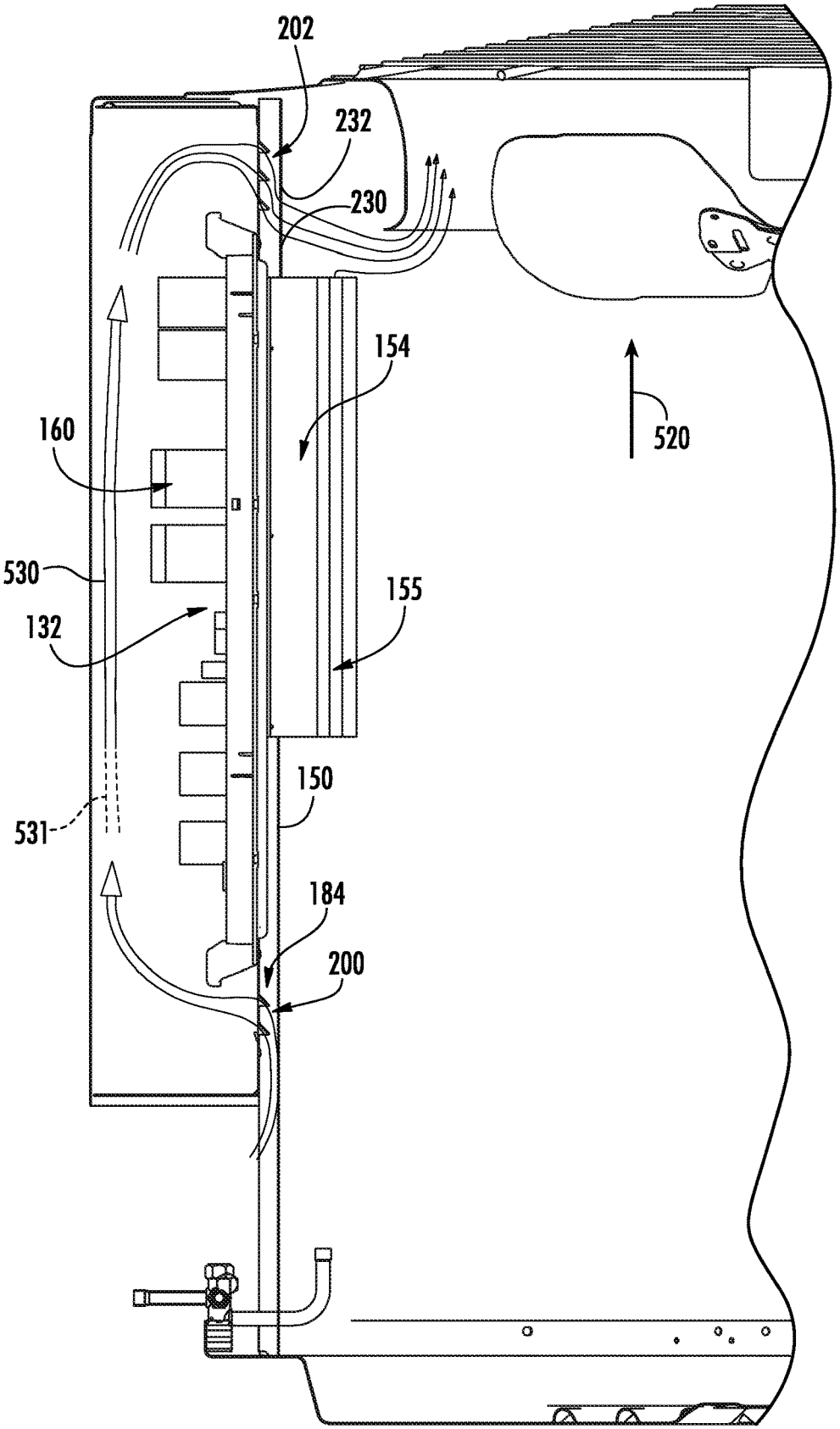
FIG. 5 is a partial vertical sectional view of the outdoor unit.

The exemplary service panel 140 further comprises a pair of vertical side rails 168 along opposite lateral extremes of the central portion 150. The side rails protrude outward and then back inward and have a peak surface 170 for mounting associated edge portions 178 of a control box panel 180 (e.g., by screws or other fasteners). The control box panel 180 itself has a main portion 181 having a central aperture 182. The side rails 168 thus hold the rear face of the control box main portion spaced apart from the front face of the service panel central portion 150 to create a gap 184 (FIG. 5).

The exemplary inverter unit comprises a peripheral flange 186 (FIG. 4A) which, along its rear face, is mounted to the control box panel 180 (such as via screws) so that the heat sink spans the gap 184 (FIG. 5) between the control box panel main portion 181 and service panel central portion 150. A control box cover 190 may have lateral portions 192 that mount to lateral portions 194 of the service panel rails 168 to enclose the control box interior. The exemplary control box panel 180 comprises a top portion 188 and bottom portion 189 at respective upper and lower extremes of the main portion 181 that mate with the cover 190 to enclose the control box to contain the various components within.

To further cool the various inverter components 160 on the opposite side of the printed circuit board 158 from the heat sink 154, an additional air flowpath 531 (FIGS. 3, 5) is provided for an air flow 530. Additional cooling allows for use in higher ambient temperature conditions and/or higher inverter voltages. Other factors being equal, the additional air flowpath passes from an inlet 200 of the control box, over the components 160, and out an outlet 202. The additional air flow then passes to merge with the other air flow(s) drawn by the fan 42 and be discharged from the outdoor unit. In the exemplary implementation, this additional air flow 530 passes across the gap 184 between control box and service panel above the heat sink to join the flow that has passed along the heat sink. To facilitate this, the exemplary outlet 202 is along the control box panel 180 main portion 181 above the aperture 182. Similarly, the service panel central portion 150 has a port above the aperture 152 for passing the flow. The exemplary embodiment utilizes a pair of such service panel ports 220A and 220B laterally spaced apart from each other with the outlet port 202 being laterally between the two. The exemplary ports 200 and 202 each comprise a vertical array of louvered ports (three shown for 202 and two shown for 200) with the louvers protruding downward and rearward (rearward from the control box point of view; inward toward the center of the outdoor unit) from the upper edge of the associated openings. Louver counts and scale may vary. For example, an otherwise similar embodiment may have four upper louvers and three. if area was to be preserved, these would have correspondingly lower height. Other combinations of louver numbers and sizes may be possible including greater number of inlet louvers and plural different sizes on a given control box panel. Other position distributions are also possible.

The louvers help protect the electronic components within the control box (e.g., the components 160) from rain. The louvers may be formed by the sheet metal stamping of the control box main panel. The lateral staggering of the ports 220A and 220B beyond the lateral edges of the openings of the port 202 helps prevent deflection of water (e.g., rain) from the louvers from, in turn, passing through the service panel. Thus, in the illustrated embodiment, the separation between the laterally inboard edges of the ports 220A and 220B is greater than the end to end width of the openings of the openings of the apertures of the port 202. The exemplary openings 220A and 220B may also be fully or partially vertically recessed from the louvers of the port 202 to help prevent splash-through off of the louvers. Thus, lower extremes 230 (FIG. 5), and optionally upper extremes 232 of the ports 220A and 220B may be below the lower extreme of the lowest aperture of the port 202. Accordingly, it is seen that by providing the flowpath through the control box and back through the service panel, supplemental cooling can be provided of inverter components opposite the heat sink to yet further reduce operational temperatures and therefore increase inverter life.

Exemplary sizes of the inlet 200 and outlet 202, are about 1.5 square inches in total each. Values above or below are possible and will depend on system and inverter size. An exemplary range is at least 1.0 square inch, but lower values are still possible.

The system may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A climate control outdoor unit comprising:
a housing;
a compressor having an electric motor;
a refrigerant-air heat exchanger;
an electric fan positioned to drive an air flow along an air flowpath across the refrigerant-air heat exchanger; and
an inverter unit coupled to the electric motor to drive the electric motor,
wherein:
an additional air flowpath extends along the inverter unit to merge with the air flowpath;
the inverter unit is mounted on a service panel of the housing and has:
a heat sink having a heat rejection section along the air flowpath protruding from an interior side of the service panel; and
a portion protruding from an exterior side of the service panel and enclosed by a control box of the housing;
the control box has a rear panel facing the service panel and locally spaced apart from the service panel by a gap, the control box having at least one inlet through the rear panel and at least one outlet through the rear panel; and
the additional air flowpath extends:
into the control box;
upward along the inverter unit portion;
rearward from the control box;
through the service panel; and
merging with the air flowpath;
the additional air flowpath enters the control box through said at least one inlet through the control box rear panel;
the additional air flowpath exits the control box through said at least one outlet through the control box rear panel;
the additional air flowpath passes directly from the at least one outlet through one or more ports in the service panel laterally spaced apart from the at least one outlet; and
the portion protruding from the exterior side of the service panel comprises power electronics of the inverter unit.

2. The climate control outdoor unit of claim 1 wherein:
the at least one inlet comprises a vertically arrayed plurality of louvered inlets; and
the at least one outlet comprises a vertically arrayed plurality of louvered outlets laterally between a first group of the one or more ports and a second group of the one or more ports.

3. The climate control outdoor unit of claim 1 wherein:
the one or more ports in the service panel are at least partially vertically below the at least one outlet.

4. The climate control outdoor unit of claim 1 wherein:
the control box rear panel has lateral portions mounted to the service panel.

5. The climate control outdoor unit of claim 1 wherein:
the refrigerant-air heat exchanger extends around a vertical axis of the climate control outdoor unit between a first header and a second header; and
the service panel is adjacent a gap between the first header and the second header.

6. The climate control outdoor unit of claim 1 wherein:
the electric fan is atop the outdoor unit.

7. The climate control outdoor unit of claim 1 wherein:
the inverter unit extends through an aperture in the control box and an aperture in the service panel.

8. The climate control outdoor unit of claim 1 further comprising:
an expansion device upstream of the refrigerant-air heat exchanger in a heating mode.

9. The climate control outdoor unit of claim 1 wherein:
a central flat portion of the service panel is parallel to and spaced apart from a flat portion of the rear panel of the control box in which the at least one outlet is formed.

10. A climate control system including the climate control outdoor unit of claim 1 and further comprising:
an indoor unit comprising:
a refrigerant-air heat exchanger downstream of the outdoor unit refrigerant-air heat exchanger and upstream of the compressor along a refrigerant flowpath; and
an electric fan positioned to drive an air flow along an air flowpath across the indoor unit refrigerant-air heat exchanger.

11. The climate control system of claim 10 wherein the indoor unit further comprises:
an expansion device upstream of the indoor unit refrigerant-air heat exchanger in a cooling mode.

12. A method for using the system of claim 1, the method comprising:
running the electric motor of the compressor to drive refrigerant through the refrigerant-air heat exchanger; and
running the electric fan to:
drive the air flow along the air flowpath across the refrigerant-air heat exchanger; and
drive an additional air flow along the additional air flowpath:
into the control box;
upward along the inverter unit;
rearward from the control box;
through the service panel; and
merging with the air flowpath.

13. The method of claim 12 further comprising:
absorbing heat from the air flow by the refrigerant-air heat exchanger.

14. The method of claim 12 wherein:
the additional air flow is drawn upward into the gap and then forwardly into the control box.

15. The method of claim 12 wherein:
the additional air flow is drawn sequentially, into the control box, across the portion, out of the control box, and through the service panel.

16. The method of claim 15 wherein:
the additional air flow is drawn laterally between the control box and the service panel.

17. The method of claim 15 wherein:
the additional air flow is drawn downwardly between the control box and the service panel.

18. A climate control outdoor unit comprising:
a housing;
a compressor having an electric motor;
a refrigerant-air heat exchanger;

an electric fan positioned to drive an air flow along an air flowpath across the refrigerant-air heat exchanger; and an inverter unit coupled to the electric motor to drive the electric motor, wherein:

an additional air flowpath extends along the inverter unit to merge with the air flowpath;

the inverter unit is mounted on a service panel of the housing and has:

a heat sink having a heat rejection section along the air flowpath protruding from an interior side of the service panel; and a portion protruding from an exterior side of the service panel and enclosed by a control box of the housing;

the control box has a rear panel facing the service panel and locally spaced apart from the service panel by a gap; and the additional air flowpath extends:

into the control box;

upward along the inverter unit portion;

rearward from the control box;

through the service panel; and merging with the air flowpath;

the additional air flowpath enters the control box through at least one inlet in the control box rear panel;

the additional air flowpath exits the control box through at least one outlet in the control box rear panel;

a first port and a second port in the service panel respectively to a first lateral side and a second lateral side of the at least one outlet; and the portion protruding from the exterior side of the service panel comprises power electronics of the inverter unit.

19. The climate control outdoor unit of claim 18 wherein:

the first port, the second port, and an aperture passing the heat sink are in a central flat portion of the service panel.

20. The climate control outdoor unit of claim 19 wherein:

the central flat portion of the service panel is parallel to and spaced apart from a flat portion of the rear panel of the control box in which the at least one outlet is formed; and the first port and the second port are laterally non-overlapping with the at least one outlet.

* * * * *